United States Patent [19]

Falloon

[11] Patent Number: 4,877,256

[45] Date of Patent: Oct. 31, 1989

[54] TOSSING GAME

[76] Inventor: David R. Falloon, 901 Pickering, Montgomery City, Mo. 63361

[21] Appl. No.: 233,148

[22] Filed: Aug. 17, 1988

Related U.S. Application Data

[63] Continuation of Ser. No. 936,142, Nov. 28, 1986, abandoned.

[51] Int. Cl.[4] ..... A63B 63/04

[52] U.S. Cl. ..... 273/400

[58] Field of Search ..... 273/398–401, 273/352, 27 R, 424

[56] References Cited

U.S. PATENT DOCUMENTS

| | | | |
|---|---|---|---|
| 324,189 | 8/1885 | Thomas | 273/400 |
| 593,343 | 11/1897 | Whitney | 273/400 |
| 827,626 | 7/1906 | Gillet | 273/402 |
| 1,568,340 | 1/1926 | McGrath | 273/399 |
| 2,050,914 | 8/1936 | Anderson | 273/102 |
| 2,126,245 | 8/1938 | Darby | 273/106 |
| 2,145,840 | 1/1939 | Thompson et al. | 273/95 |
| 2,287,113 | 6/1942 | Markey | 273/105 |
| 2,326,859 | 8/1943 | Hoover | 273/95 |
| 2,926,915 | 3/1960 | Johns | 273/352 |
| 3,653,662 | 4/1972 | Welbourn | 273/400 |
| 4,012,042 | 5/1977 | Blasingame | 273/95 R |
| 4,203,592 | 5/1980 | Quatkemeyer | 273/336 |
| 4,204,682 | 5/1980 | Brown | 273/401 |
| 4,392,653 | 7/1983 | Blume | 273/400 |

*Primary Examiner*—Edward M. Coven
*Assistant Examiner*—Mark J. Graham
*Attorney, Agent, or Firm*—Polster, Polster and Lucchesi

[57] ABSTRACT

A tossing game is disclosed which utilizes a pair of target areas or trays placed on the ground at a desired distance from one another. Each of the target areas or trays has a plurality of cups of varying heights. The players toss projectiles (preferably disks) from a position adjacent one of the target areas to the other. Points are scored by landing a projectile either on the tray or in one of the cups, with the number of points increasing when the projectile lands in the taller ones of the cups.

3 Claims, 1 Drawing Sheet

TOSSING GAME

This is a continuation application of copending application Ser. No. 936,142 filed on Nov. 28, 1986, now abandoned.

BACKGROUND OF THE INVENTION

This invention relates to a tossing or throwing game intended either for indoor or outdoor play.

Of course, one of the most popular tossing or pitching games is horseshoe pitching in which two stakes are placed in the ground and the players throw or pitch horseshoes from one stake to the other. However, horseshoes is typically played outside and requires the use of horseshoe pits which, at a minimum, utilize a steel rod firmly driven into the ground. Usually, it is not an easy matter to play horseshoes indoors.

Reference may be made to U.S. Pat. Nos. 2,145,840 and 2,326,859, which discloses bowling-type games in which a ball is rolled along the ground, up a ramp into an inclined or horizontal target area having a number of rings or other targets located thereon. Scoring is accomplished by determining the number of points of the various target areas in which the balls land.

U.S. patent 2,050,914 discloses a game board which has a shock mounting feature such that when balls or other projectiles are thrown into the inclined surface thereof, the table will "give", thus absorbing shock. Different target areas are provided on the board which, of course, can account for variations in scoring.

U.S. Pat. Nos. 2,126,245, 2,287,113, 4,012,042, 4,203,592, and 4,204,682 disclose a number of other tossing or throwing games in the same general field as the present invention. However, many of these other tossing or throwing games require target areas or the like which are either required to be dug into the ground, or which are substantially different in concept and construction from the present invention.

There has been a long-standing need for a tossing or throwing game in which the players can rapidly acquire a minimum level of skill so as to play the game effectively, and yet which offers sufficient mental and physical challenge so as to prevent the players from becoming bored with playing the game.

SUMMARY OF THE INVENTION

Among the several objects and features of the present invention may be noted the provision of a tossing game which may be readily played either indoors or outdoors without the necessity of any special preparation, such as driving stakes into the earth or digging target holes;

The provision of such a tossing game in which the target areas may merely be laid on the ground or on the floor;

The provision of such a tossing game which does not require a ball to be rolled along a level surface;

The provision of such a tossing game in which the target areas or trays are portable and may be easily stored;

The provision of such a tossing game which may be played by as few as two persons or two teams;

The provision of such a tossing game during the play of which the players may score offensively and defensively, that is, scoring points for themselves or taking points away from an opponent; and The provision of such a tossing game which is of simple and rugged construction, which will readily withstand hard use, which is relatively easy to manufacture, and which can be economically manufactured.

Other objects and features of this invention will be in part apparent and in part pointed out hereinafter.

Briefly stated, a tossing game of the present invention comprises a pair of spaced target areas and a plurality of projectiles tossed by one or more players from a position near one of the target areas to the other target area. Each of the target areas comprises a tray having a base adapted to rest on the ground or floor and upstanding walls around the base. A plurality of cups is provided within the tray, with the cups being of various heights, and with the cups being secured to the tray base, with the shortest of the cups extending above the tray walls. The cups each have a cross section larger than the maximum cross section of the projectile such that the cups are capable of receiving the projectiles when tossed therein. The tray with the cups thereon is of sufficient size so as to receive projectiles landing within the walls of the tray but outside the cups.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
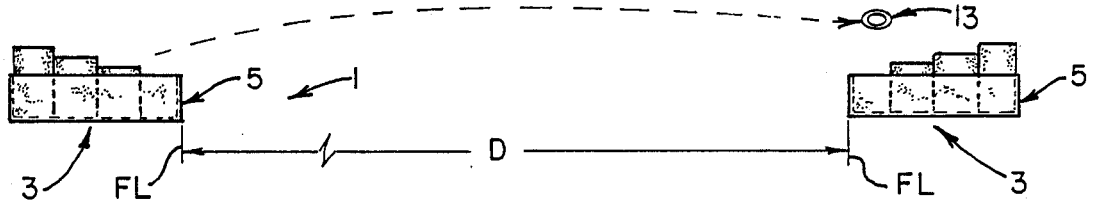
FIG. 1 is a side elevational view of the tossing game of the present invention illustrating two target areas spaced from one another and illustrating a projectile being thrown from a position adjacent one of the target areas toward the other target area.
Figure 2:
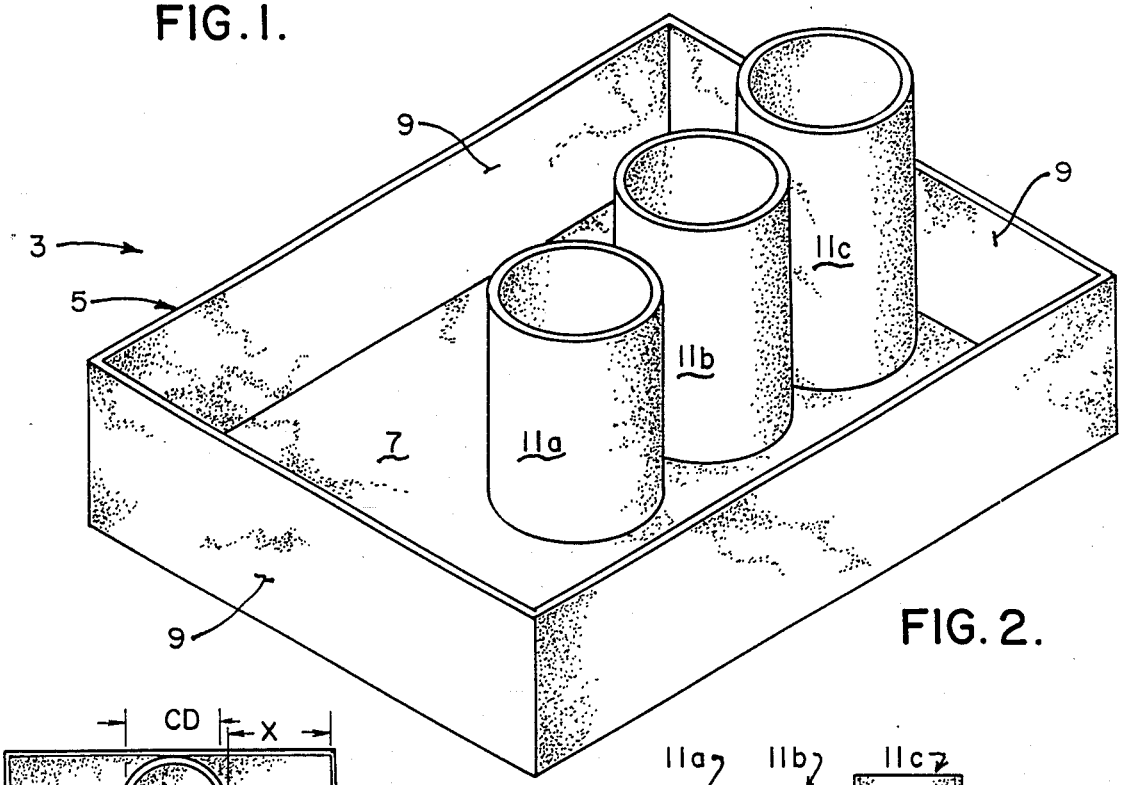
FIG. 2 is an enlarged perspective view of one of the target areas, illustrating a tray in which a plurality of cups (e.g., three) are mounted in vertical position, with the cups being of varying height, and with all of the cups being somewhat taller than the walls of the tray.

Referring now to the drawings, a tossing or throwing game of the present invention is indicated in its entirety by reference character 1. More specifically, tossing game 1 comprises two spaced apart target areas, as generally indicated at 3. Preferably, these target areas are merely placed on the ground (if the game is to be played out of doors), or placed on the floor (if the game is to be played indoors), at a predetermined spaced apart distance D (e.g., 25 feet).

Figure 5:
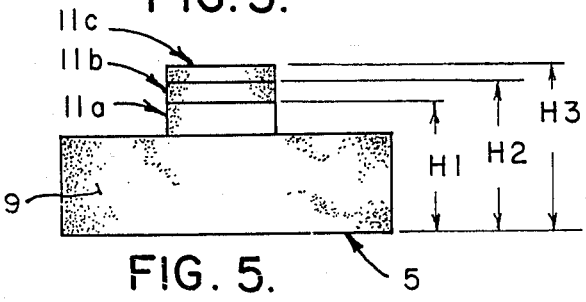
FIG. 5 is an end elevational view of FIG. 3.
Figure 6:
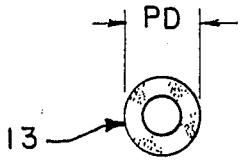
FIG. 6 is a plan view of an annular disk-like projectile utilized in the play of the tossing game of the present invention.

Each of the target areas 3 comprises a tray 5 having a base 7 with vertical walls 9 extending upwardly from the base. A plurality (e.g., three) of upright cups **11*a*–11*c* are fixedly secured to base 7 of tray 5 within the tray. As illustrated in the drawings, the cups 11*a*–11*c* are of varying height, with the shortest cup 11a being somewhat taller than the height of tray walls 9, and with the remaining cups 11*b* and 11*c* being somewhat taller than cup 11*a*, with cup 11*c* being the tallest cup. The height of these cups is best illustrated in FIG. 5, where the heights of cups 11*a*–11*c*** are indicated by H1–H3, respectively.

Further in accordance with this invention, one or more projectiles, as generally indicated at 13, are intended to be thrown from a location near one of the target areas 3 toward the other target area, with the intent of the player being preferably to cause the projectile to enter the tallest cylinder 11c, thereby to score the most points, or alternatively, to land the projectile in one of the other cylinders to score lesser amounts of points, or to land the projectile in the tray surrounding the cups 11a–11c, thereby to score a minimum number of points. If the projectile lands outside of tray 5, no points are scored.

Figure 3:
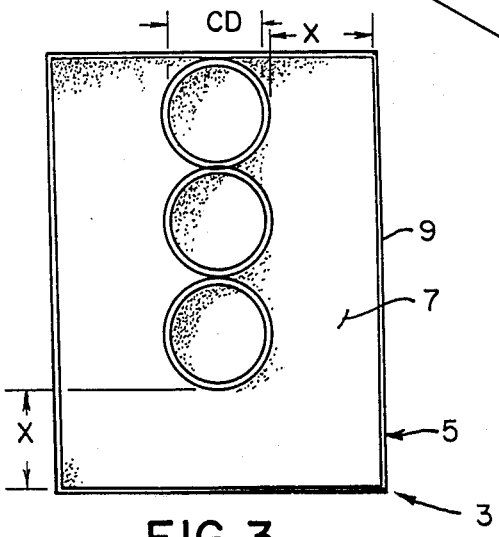
FIG. 3 is a plan view, on a reduced scale, of the tray as shown in FIG. 2, illustrating the position of the cups within the tray.
Figure 4:
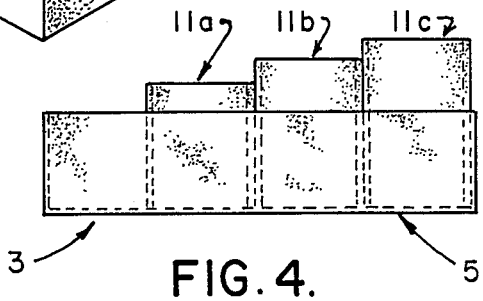
FIG. 4 is a side elevational view of FIG. 3.

Preferably, but not necessarily, projectile 13 is an annular disk-like projectile of sheet material, having a size and weight so that it can be readily thrown or tossed by a variety of players of varying ages and physical abilities. For example, projectile 13 may be in the form of a flat washer made of sheet metal, having an outer diameter or projectile diameter PD, of about two and one-half inches, with an opening in the center having a diameter of about one inch. As shown in FIG. 3, the inner diameter of the cups 11a–11c, as indicated at CD, is preferably about four and one-quarter inches (10.8 cm.). Additionally, the spacing between the outer surfaces of the cup and the inner surfaces of an adjacent side wall 9 of tray 5, as indicated at X, is preferably about four and one-quarter inches (10.8 cm.). Also the distance between the front wall of the tray and the shortest cup 11a is also indicated by dimension X and is also approximately four and one-quarter inches (10.8 cm.). It will further be noted that the inner dimensions of tray 5 are approximately twelve and three-quarter inches wide by seventeen inches long (32.4×43.2 cm.). The cups 11a–11c are arranged in a straight line generally along the center of the tray, as viewed from above in FIG. 3, with the tallest and rearmost cup 11c being in contacting relation with the rear wall of tray 5, and with the remaining cups 11b and 11a contacting cup 11c and cup 11b, respectively. As shown in FIG. 1, with the target areas 3 disposed on the ground, their predetermined distance D apart (e.g., 25 feet or 7.6 m.), the front walls of the tray 5 are constituted by the walls of the tray spaced from cup 11a.

Utilizing trays 5, cups 11a–11c, and projectiles 13 of the dimensions illustrated in the above-identified example, or utilizing generally similar proportional dimensional ratios, it has been found that a certain minimum level of skill is required for the players to repeatedly land the projectiles 13 within the walls 9 of tray 5, and more particularly within any selected one of cups 11a–11c. Yet, on the other hand, with the inner diameter CD of cups 11a–11c being about 1.7 times greater than the projectile diameter PD, and with the distance between the inner walls 9 of tray 5 and the cups 11a–11c also being about 1.7 times greater than the projectile diameter PD, the level of skill required by players to score points is not exceedingly difficult. Those skilled in the art will appreciate that the above dimensional ratio between the projectile diameter PD, the cup diameter CD, and the spacing between the tray walls and the cups X (i.e., CD/PD or X/PD) may range between about 1.2 and 2.2 or greater.

Still further, by way of example, the height of tray walls 9 may, for example, be about four inches (10.2 cm.) above the level of tray base 7. Also, the height H1 of cup 11a may be about five inches (12.7 cm.) tall, with the height H2 of cup 11b being about five and three-quarter inches (14.6 cm.) tall, and with the height H3 of the third cup 11c being about six and one-half inches (16.5 cm.) tall.

In accordance with the method of this invention, tossing game 1 of the present invention may be played by two individuals or two teams of players. In one example, it will be assumed that there are four players, two on each team, with one player on each team positioned adjacent each of the target areas 3. Each player throws a plurality (e.g., three) of the projectiles 13 on each turn, with the object to outscore the opposing player or team. A game may be won when the score reaches or exceeds a predetermined limit, for example, 21 points. A foul line FL may be drawn substantially coincident with the front wall of each tray 5 (as shown in FIG. 1) such that the players should not cross this line while throwing projectiles 13. However, if all players are in agreement, it may be determined before play starts to allow players to take one step from the foul line toward the opposite target when tossing their projectiles. This can especially benefit children when playing the game. The player tosses the projectile from one target area toward the other, with the object being to land the projectiles within tray 5, or within one of the cups 11a–11c. Points are scored in accordance with the final resting place of the projectiles after all of the projectiles thrown by a player have landed. Alternatively, the score may be tallied after the players on each team standing at one target area have each thrown their respective three projectiles. It will be appreciated that the projectiles of the different teams may be of a different color or otherwise marked so as to differentiate the projectiles. For example, a projectile landing outside of tray 5 will not be awarded any points. A projectile landing within tray 5, but not within any of the cups 11a–11c, will be awarded one point. Two, three, and four points will be awarded if the projectile lands in cups 11a, 11b, or 11c, respectively. If a projectile lands within tray 5 and lands on the upper edge of the cup and does not fall into a cup, it will be awarded one point. However, any such projectiles may subsequently knocked off by the throwing of another projectile by either player, knocking these projectiles from one of the cups onto the tray or in the cup. In that manner, points may be deducted from one player and added onto the other. The game will continue until one player or team has scored 21 points and wins by at least two points.

Alternatively, the game of the present invention may be scored in a somewhat different manner, particularly during team play. Assuming there are two teams with two players at ech of the spaced trays 5, with each player tossing two projectiles 13, a player from the first team may toss two projectiles into the tray 7 and one projectile into cup 11b to score a total of five points on his throw. When the player from the other team standing at the same tray tosses his three projectiles toward the opposite tray area, he may, for example, throw one projectile into the tray area so as to score one point, and one projectile into cup 11c thereby to score four points, such that each of the players had a total score of five points. Since both teams had the same number of points after their throw, the result is no points are scored for either team.

If, however, a player from the first team has a combined score greater than the player from the second team, then it is the difference between the score which counts as points for the team. In this manner, the player from one team may cancel out any points scored by his corresponding player on the other team, thus resulting in no score for either team, or in giving up or taking away points relative to the opposing team.

It will also be noted that during singles play with two persons, both players can stand at one target and toss to the opposing target, then tally their score if any, and walk to the next target to collect the projectiles, and thus toss them back to the first target. It will also be appreciated that, in this manner, the team play method of scoring, as described above, may be utilized, if so desired.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A tossing game comprising a pair of spaced target areas and a plurality of projectiles tossed by one or more players from a position proximate one of the target areas to the other, each of said target areas comprising a tray having a base adapted to rest on the ground and upstanding vertical walls around the base, a plurality of vertical cups within the tray of varying height secured to the tray base, with said cups being arranged on their respective said base generally along a line between said target areas with the ends of said target areas closest to one another constituting their front ends with their ends distal one another constituting their respective rear ends, with the shortest of said cups being in front and extending above the level of said vertical walls, with the tallest of said cups being in the rear, and positioned adjacent to and in touching relation with the rear vertical wall of the tray, and with the height of any intermediate cups progressively increasing from front to rear, said cups being in side-to-side touching relation, said cups each having a cross section ranging between about 1.2 and 2.2 times the maximum cross section of said projectile such that the cups are capable of receiving said projectiles when tossed therein, said tray having side vertical walls the distance between said cups and the side vertical walls being between about 1.2 and 2.2 times the maximum size of said projectiles so as to receive said projectiles landing within the walls of the trays on the base outside of said cups.

2. A tossing game as set forth in claim 1 wherein the cross section of said cups is about 1.5 times the cross section of said projectile.

3. A tossing game as set forth in claim 2 wherein the distance between the sides of said cups and said side vertical walls and the distance between the front of said front cup and said front vertical wall is about 1.5 times the cross section of said projectile.

* * * * *